US005704793A

United States Patent [19]

Stokoe et al.

[11] Patent Number: 5,704,793

[45] Date of Patent: Jan. 6, 1998

[54] HIGH SPEED HIGH DENSITY CONNECTOR FOR ELECTRONIC SIGNALS

[75] Inventors: Philip T. Stokoe, Attleboro, Mass.; Edward C. Ekstrom, Merrimack, N.H.

[73] Assignee: Teradyne, Inc., Boston, Mass.

[21] Appl. No.: 423,595

[22] Filed: Apr. 17, 1995

[51] Int. Cl.[6] ..... H01R 9/09

[52] U.S. Cl. ..... 439/62; 439/67

[58] Field of Search ..... 439/62, 67, 326

[56] References Cited

U.S. PATENT DOCUMENTS

| | | | |
|---|---|---|---|
| 3,609,463 | 9/1971 | Laboue | 439/67 X |
| 4,636,019 | 1/1987 | Gillett et al. | 439/62 |
| 4,911,653 | 3/1990 | Walton et al. . | |
| 4,934,942 | 6/1990 | Casciotti et al. . | |
| 4,968,265 | 11/1990 | Fox, Jr. . | |
| 5,002,496 | 3/1991 | Fox, Jr. . | |
| 5,123,852 | 6/1992 | Gillett | 439/67 |
| 5,156,553 | 10/1992 | Katsumata et al. | 439/62 |
| 5,171,154 | 12/1992 | Casciotti et al. . | |
| 5,368,491 | 11/1994 | Locati . | |
| 5,378,161 | 1/1995 | Loder | 439/62 X |
| 5,505,626 | 4/1996 | Grabbe et al. | 439/62 |

FOREIGN PATENT DOCUMENTS 429340 5/1991 European Pat. Off. .

OTHER PUBLICATIONS

*A High Density, Flex Circuit Based, Pressure Interconnect System For High Speed Backplane Applications,* David McNamara No Date.

*A Modular Surface Mount–Compatible Interconnection System For High Speed Applications* Gandhi et al. No Date.

Teradyne Schematic DVO–2990–000 No Date.

High Density Field REplaceable Flexible Circuit Connector. Campbell and Howe. IBM Technical Disclosure Bulletin 1991 No Month.

High–performance connectors enter system spotlight. Caruthers. Computer Design 1993 No Month.

*Primary Examiner*—Jes F. Pascua

*Attorney, Agent, or Firm*—Edmund J. Walsh

[57] ABSTRACT

A connector for printed circuit boards. Electrical connections are made between two printed boards through flex circuits which have contact pads pressed against contact pads on each of the printed circuit boards. Sufficient, uniform pressure is maintained on the contacts through the use of compressible tubes behind the contact pads on the flex circuits. The compressible tubes are spring biased towards the flex circuits. When a circuit board is engaged in the connector, it compresses the compressible tube and the spring biasing mechanism, thereby generating sufficient contact force. The connector is easy to manufacture in a variety of sizes because its pieces are modular. Many of the pieces are of uniform cross section, facilitating use of low cost extrusion operations. An embodiment is disclosed in which one printed circuit board is pivoted into contact with the contact pads.

3 Claims, 3 Drawing Sheets

HIGH SPEED HIGH DENSITY CONNECTOR FOR ELECTRONIC SIGNALS

This invention relates generally to connectors for electronic signals and more specifically to high speed, high density connectors for electronic signals.

Connectors are used widely in the electronics industry. Many electronic items, such as computers, are built as modules which are then connected into a system. For example, a computer is usually assembled from several printed circuit boards which are each plugged into a "backplane." The backplane routes signals between the printed circuit boards. For that reason, connectors are often discussed as they relate to connecting a printed circuit board to a backplane, but they can be used for making connections between many other items.

Some device, called generally a "connector", is used to complete the electrical path for signals between the backplane and the printed circuit board. It is desirable that the connector allow the printed circuit board to be easily connected to and removed from the backplane. It is also desirable that the connector not significantly distort signals or add noise to the signals as they pass between the backplane and the printed circuit board.

Connectors are also used to electrically connect a single printed circuit board to another printed circuit board. A board into which another printed circuit board is plugged is sometimes called a "motherboard." The same types of connectors used in backplanes are also used on motherboards. When the term "backplane" is used herein, it encompasses a "motherboard" configuration.

One form of connector uses metal posts or blades. The posts or blades are enclosed in a housing, which is usually mounted to the backplane. Another housing is mounted to the printed circuit board. This housing contains other metal contacts. When the two connector housings are mated, the metal contacts in each housing touch. The contacts are made thin enough that they have some springiness. The springiness ensures good mechanical contact.

Such connectors are suitable for many applications. However, they do not perform well in applications which require a large number of high speed, high density interconnections. The density of a connector refers to the number of signals which can be carried per unit length or area of the connector.

The speed of the connector refers to the rise time of signals which can be passed through the connector with an acceptable level of distortion or added noise. The rise time of a signal is related to the highest frequency components contained in that signal such that frequency and rise time are alternative ways to view the speed of an electronic signal.

Several different techniques are used for rating the speed of a connector. One way is to measure signal reflections caused by impedance variations in the signal path. This measurement may be performed in the time domain by means of a time domain reflectometry (TDR) instrument. This instrument produces a test signal in the form of a voltage step of known amplitude and rise time. The reflected signal, expressed as a percentage of the input amplitude, is measured as an indication of distortion.

As the rise time of the test signal is made shorter, the distortion will increase. A maximum acceptable level of distortion is defined based on the intended application for the connector. TDR measurements are made with test signals having different rise times until the smallest rise time which produces less than the maximum acceptable distortion is identified.

For example, a reflection level of 5% is considered to be acceptable for many applications. If a signal with a rise time of 250 psec produces 5% reflection, the connector is said to be a 250 psec connector.

Other criteria are also sometimes important for a connector. For example, sometimes the noise introduced through cross talk between signal contacts within the connector is important. Where other criteria are specified, the fastest signal which satisfies all criteria gives the speed rating for the connector.

Connector speed and density are usually inversely related. Distortion and noise of a connector can often be reduced by making the adjacent contacts further apart. This increases speed but reduces density. A second way is to connect adjacent signal contacts to ground. The grounded contacts act as shields and reduce the cross talk between contacts carrying signals.

However, when contacts are connected to ground, they can not carry signals. Density of a connector is sometimes states in terms of "real signals per unit length." In determining the real signal density of a connector, those connectors connected to ground are not counted.

Existing connectors using conventional metal contacts can provide a maximum signal density of 35 real signals per inch at a speed of 0.5 nsec. It would be desirable to provide 50 real signals per inch at 0.5 nsec and 35 real signals per inch at 0.2 nsec.

One way to achieve such a combination of speed and density was suggested in U.S. Pat. Nos. 4,968,265 and 5,002,496. Those patents describe a connector which uses a flex circuit. A flex circuit is made up of numerous metal traces running in parallel on a flexible substrate. The traces are covered over with a dielectric material, which is also flexible. At each end of the flex circuit, there are openings in the dielectric covering, exposing pads on each trace where electrical connection can be made. In the connector, one end of the flex circuit is held against pads on the backplane. The other end of the flex circuit is held against pads on the printed circuit board.

In this way, electrical connections are made from the backplane to the printed circuit board through the traces on the flex circuit. The flex circuit inherently has very low distortion and can thus handle high speed signals even when the traces are very close together.

In this connector, the flex circuit was held against either the backplane or the printed circuit board through the use of a fluid filled bladder. The bladder was held in a fixed support. The flex circuit was mounted between the bladder and a printed circuit board. To provide good mechanical contact, a force was exerted on the bladder at one point. Because the bladder was fluid filled, it conformed to the shape of the printed circuit board and applied the force evenly over the printed circuit board.

This type of connector suffered from the disadvantage of requiring fluid. Fluids usually interfere with the operation of electronic devices, such as by shorting out connections. There was considerable reluctance to use in electronics a connector which contained fluid.

Through our studies of connectors of this type, we discovered that the pressure in the bladder increased rapidly as a function of displacement. This relationship made it difficult to manufacture connectors of this type. The displacement of the bladder had to be carefully controlled. Too much displacement yielded connectors which were hard to operate. Too little displacement yielded connectors which did not have good electrical properties.

We have observed an alternative design which improved the second drawback. In these connectors the bladder was mounted in a support. A printed circuit board to be plugged into the connector included camming surfaces which deformed the support for the bladder when the printed circuit board was plugged into the connector. Deformation of the support provided force on the bladder. We observed that this design allowed the force on the bladder to be more easily controlled. However, this design did not eliminate the need for fluid in the connector. It also was complicated to use because the camming surfaces had to be attached to the printed circuit board to be plugged into the connector.

An alternative flex connector used a coiled spring in place of the bladder. This connector, sold by AMP, Inc. of Harrisburg, Pa. under the designation ASC, used a canted coil spring in place of the fluid filled bladder.

SUMMARY OF THE INVENTION

With the foregoing background in mind, it is an object of the invention to provide a high speed, high density electrical connector.

It is also an object to provide an electrical connector which is easy to manufacture and easy to use.

The foregoing and other objects are achieved in a connector using flex circuits. Contact pads on the flex connector are held against contact pads on a printed circuit board through the use of a compressible member. The compressible member is held in a support which is spring loaded in the connector housing.

In one embodiment, the support for the elastomer tube is formed from an elongated member having a groove running along its length. Several modular elements are inserted into the groove. Each modular element has a spring member biasing it away from the elongated member. Each modular element also contains a groove in a surface facing away from the elongated member. The elastomer tube is inserted into the grooves of the modular elements.

In one embodiment, the connector housing includes a means for rotating the printed circuit board about a pivot point to bring pads on the printed circuit board into contact with pads on the flex circuit.

BRIEF DESCRIPTION OF THE DRAWINGS

The invention will be better understood by reference to the following more detailed description and accompanying drawings in which.

DESCRIPTION OF THE PREFERRED EMBODIMENT

Figure 1:
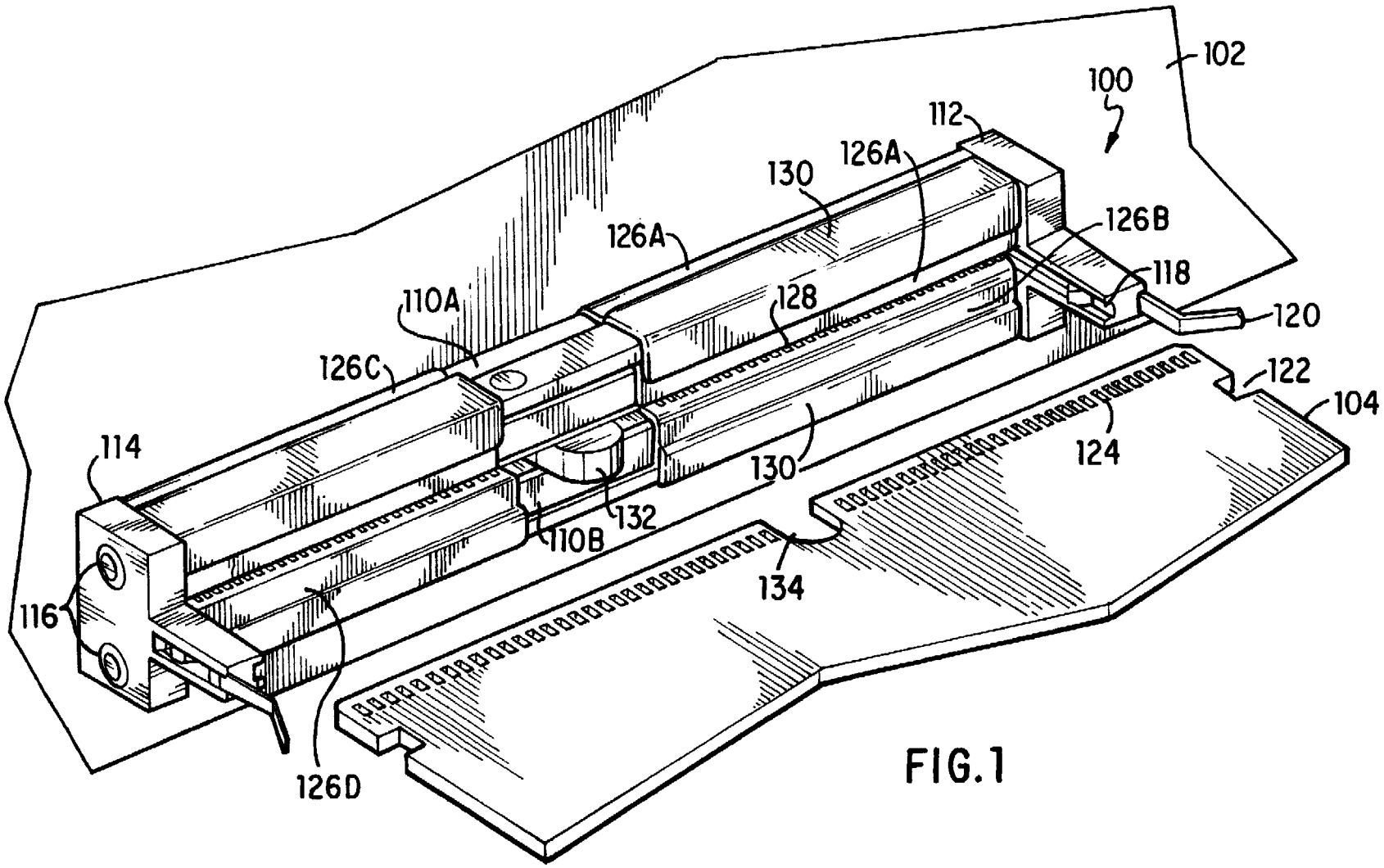
FIG. 1 is a sketch of the connector of the invention.

FIG. 1 shows a connector 100 mounted to backplane 102. Connector 100 is designed to receive daughter card 104, which is a printed circuit board. Connector 100 provides a high speed, high density connection between daughter card 104 and backplane 102.

Connector 100 contains two backbone elements 110A and 110B. Backbone elements 110A and 110B are identical, but are oriented so that backbone 110A is the mirror image of 110B. Backbone elements 110A and 110B are held between end caps 112 and 114. Backbones 110A and 110B are held in place by any convenient mounting means, such as screws 116. Backbone elements 110A and 110B are spaced apart by an amount sufficient to allow daughter card 104 to be inserted between them.

End caps 112 and 114 contain grooves 118, which are adapted to guide daughter card 104 into the space between backbone elements 110A and 110B. End caps 112 and 114 may include some mechanism to lock daughter card 104 in place when engaged in connector 100. Here, locking tabs 120 are shown to engage slots 122 on daughter card 122.

End caps 112 and 114 are secured to backplane 102 by any convenient means. Here, screws (not shown) are used.

Connector 100 includes flex strips 126A, 126B, 126C and 126D. Flex strips 126A and 126C wrap around backbone 110A. Flex strips 126B and 126D wrap around backbone 110B. Each of the flex strips 126A . . . 126D has conductive traces (not shown) and contact pads 128 (only a portion of which are visible) at each end. Each of the flex circuits 126A . . . 126D has contact pads 128 at one end facing into the gap between backbone elements 110A and 110B and contact pads (not shown) on their other end facing backplane 102.

Flex strips are commercially available, such as from Fuji Poly. In the preferred embodiment, the traces are 2 mil wide, but any dimension might be used. Some such flex strips include a ground plane. Such flex strips may be used and reduce crosstalk.

Flex strips 126A . . . 126D are held in place by clamps 130. Clamps 130 may be held in place with screws (not shown) or might simply be shaped to engage features on backbone elements 110A and 110B with a snap fit.

Daughter card 104 contains numerous contact pads 124. Contact pads 124 on the upper surface of daughter card 104 are visible in FIG. 1, but in a preferred embodiment, there are also contact pads on the lower surface of daughter card 104. Contact pads 124 are exposed portions of circuit traces (not shown) on daughter card 104. Signals which are to be coupled to backplane 102 through connector 100 are routed to contact pads 124. Contact pads 128 are pressed against contact pads 124 when daughter card 104 is inserted into connector 100, thereby coupling signals to one end of flex circuits 126A . . . 126D.

The other ends of flex circuits 126A . . . 126D also contain contact pads (not shown). These contact pads press against backplane 102. Backplane 102 also has contact pads which align with the contact pads on flex circuits 126A . . . 126D. As with daughter card 104, circuit traces connect to the contact pads on backplane 102. Signals are coupled between daughter card 104 and backplane 102 through flex circuits 126A . . . 126D.

FIG. 1 shows tab 132 in connector 100. Tab 132 fits into slot 134 in daughter card 104. Tab 132 aids in aligning daughter card 104 with connector 100, but are optional.

Figures 2A, 2B:
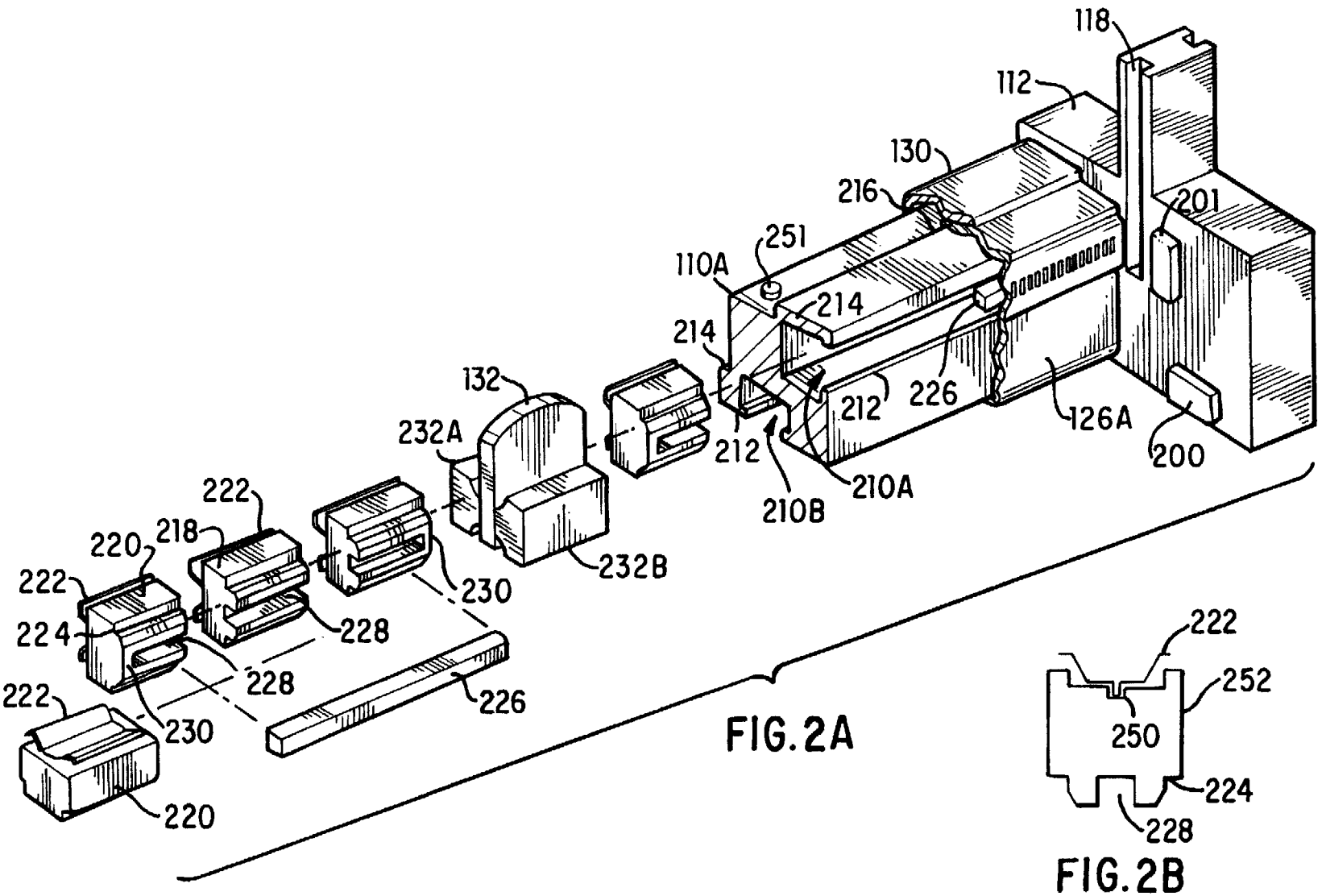
FIG. 2A is a sketch of a portion of the connector of FIG. 1 partially exploded and partially broken away.
FIG. 2B is a cross sectional view of a module shown in FIG. 2A.

Turning now to FIG. 2A, additional details of the construction of connector 100 are shown. In FIG. 2A, end cap 112 is shown without backbone 110B in place.

Backbone 110A is preferably made of anodized aluminum or some other nonconductive material or material with a dielectric coating. Any known manufacturing technique can be used, such as machining. However, it should be noted that backbone 110A has a uniform cross section along its length, enabling the use of low cost manufacturing processes, such as extrusion or pultrusion, referred to generally as extrusion processes.

Backbone 110A has grooves 210A and 210B formed in it. As shown in FIG. 1, groove 210A is behind contact pads 128 which make contact with daughter card 104. Groove 210B is behind contact pads (not shown) which make contact with backplane 102.

Backbone 110A includes ledges 214. Tabs 216 on flex circuit 126A engage ledges 214. Clamp 130 holds flex circuit 126A against backbone 110A. Clamp 130 holds tabs 216 in contact with ledges 214 and thereby holds flex circuits 126 in place.

Pins 251 aid in holding flex circuits 126 in place and also in positioning flex circuits 126. A plurality of such pins 251 are included along the length of each backbone element 110A and 110B. For each flex circuit 126, at least one of the pins is accurately positioned with respect to the end caps 112 and 114. A hole (not shown) on the flex circuit 126, which is accurately positioned with respect to the contact pads 128 on the flex circuit slips over the accurately positioned pin 251. That hole has a diameter which matches the outside diameter of pin 251, aligning the flex circuit with the pin. As both the flex circuit and end cap are positioned relative to the pin, the end cap and flex circuit are positioned relative to each other.

Additional pins 251 are also included. The additional pins are not placed with the same accuracy as the pin used for positioning the flex circuits. Holes on the flex circuits 126 fit over these pins. Rather than having a diameter matching the diameter of the pin, these holes are slightly elongated to allow for a slight inaccuracy in their placement.

Backbone 110A, along with clamp 130 and flex circuit 126A are inserted into a recess (not visible) in end cap 112. A similar recess 200 for accepting backbone 110B is shown.

Modules 218 are sized to fit into grooves 210A and 210B. Each module 218 has a step 224 which is designed to engage lip 212 on backbone 110A. In this way, modules 218 may be loaded into grooves 210A and 210B while end cap 114 is removed. Once both end caps 112 and 114 are secured, modules 218 are retained by lips 212.

Each module 218 includes a groove 228. Groove 228 is sized to receive an elastomer member 226. Elastomer member 226 is a flexible tube. When connector 100 is assembled, elastomer member 226 runs behind pads 128 of flex circuit 126. Elastomer member 226 should have a width sufficient to ensure that all of pads 128 are backed by the elastomer member 226.

Elastomer member 226 is a flexible tube. It should be elastic enough to return to its original shape after application of a force in excess of 350 pounds per square inch. Over the usable life of connector 100, elastomer member 226 should preferably loose no more than 20% of its elasticity. Many cross linked polymers with relatively long backbones are suitable. A preferred material is commercial grade polyurethane. In the preferred embodiment, elastomer member has a generally square cross section with sides about $^{50}/_{1000}$ of an inch. This size is approximately the same as the size of the contacts 128. Also, a solid member is preferred. However, an air or gas filled tube, sealed at its ends, might also be used.

Grooves 228 preferably has a width slightly smaller than elastomer member 226 such that elastomer member must be slightly compressed to fit into grooves 228. Also, grooves 228 preferably are not as deep as elastomer member 226 so that elastomer member 226 projects slightly beyond the surface of modules 218. A projection in the range of $^{5}/_{1000}$ to $^{10}/_{1000}$ of an inch is preferred with a projection of about $^{8}/_{1000}$ more preferred. The amount of projection should be limited so that when a force is placed on the elastomer member 226 it compresses back into groove 228 rather than being pressed against the front face of modules 218 and 220.

Modules 218 are shorter than the width of the flex circuits 126A . . . 126D. To provide a groove 228 to hold an elastomer member 226 behind each flex circuit 126A . . . 126D, multiple modules 218 are inserted into grooves 210A and 210B. Modules 218 have a width such that multiple modules can be used to provide a connector of any desired length.

As described above, groove 218 is sized to snugly hold elastomer member 226. The walls of groove 218 provide support perpendicular to the axis of elastomer member 226. They do not provide support along the axis of elastomer 226. To retain elastomer 226 at its ends, end modules 220 are inserted into grooves 210A and 210B. End modules 220 differ from modules 218 in that they contain end plugs 230 in grooves 228. End plugs 230 support elastomer member 226 at its end. They are positioned to snugly hold elastomer member 226.

Modules 218 and end modules 220 are made from a rigid material, which is preferably nonconductive. In a preferred embodiment, modules 218 and 220 are made of anodized aluminum. Because modules 218 have a uniform cross section, they can be made using an extrusion process. During manufacture, a bar of material having the cross section of modules 218 is extruded. The bar is then cut to the desired length of modules 218.

Modules 220 do not have a uniform cross section because of the presence of end plugs 230. An end module 220 could be made from a module 218 by securing an end cap 230 into groove 228. Alternatively, end modules 220 could be molded or machined. Alternatively, a bar of material could be extruded with a cross section identical to that of end module 220 without groove 228 in it. The bar would be cut into modules of the desired length. Groove 228 could then be machined into the modules, leaving end caps 230.

Modules 218 and end modules 220 are sized so that they have a width between step 224 and the parallel rear surface which is smaller than the distance between the inner surface of lip 212 and the floor of grooves 210A or 210B. The difference in these dimensions allows modules 218 and end modules 220 to recede into grooves 210A or 210B.

Modules 218 and end modules 220 contain springs 222 attached to the surface opposite grooves 228. Springs 222 are made from a piece of stainless spring steel bent as shown in FIG. 2A. Each spring 222 is attached to a module 218 or end module 220 by any convenient means such as welding, soldering or brazing. FIG. 2B shows a module 218 in cross section. FIG. 2B shows that springs 222 are pressed into a groove 250 for a snap fit.

Springs 222 are sized such that the distance between spring 222 and step 224 is slightly greater than the distance between the inner surface of lip 212 and the floor of grooves 210A or 210B. Springs 222 are thus compressed slightly when modules 218 and end modules 220 are inserted into grooves 210A and 210B.

Springs 222 bias modules 218 and end modules 220 forward in grooves 210A and 210B such that step 224 is urged into contact with lip 212. However, springs 222 allow compliance of modules 218 and end modules 220 to forces applied perpendicular to their faces contain grooves 228. FIG. 2B shows that modules 218 and 220 are made with anti-overstress tabs 252 if an excessive force is applied, anti-overstress tabs 252 limit the compression on spring 222 and therefore prevent permanent deformation of the springs.

Tab 132 is attached to support module 232A through any convenient means, such as welding or brazing. Support module 232A has a cross section which allows it to fit into groove 210A. The opposite side of tab 132 is connected to a support module 232B, which is identical to module 232A. Module 232B fits into a corresponding groove in backbone element 110B. Support modules 232A and 232B might be extruded as described above for the other modules and then attached to tab 132. Alternatively, the entire assembly might be formed using an extrusion process.

The spacing between backbone elements 110A and 110B is set by tabs 200 and 201 in end caps 112 and 114. However, if backbone elements 110A and 110B are too long, they will deflect in the middle such that the desired spacing will not be maintained. The assembly made up of support modules 232A and 232B enforces the required spacing between backbone elements 110A and 110B. In the preferred embodiment, such an assembly is included approximately every two and a half inches along the length of backbone elements 110A and 110B.

Using modules 218, end modules 220 and support modules 232 allows connectors of many sizes and configurations to be easily assembled. Backbones 110A and 110B are cut to the desired length. Grooves 210A and 210B are loaded with modules. For each flex circuit 126 to be used in connector 100, each of the grooves 210A and 210B is loaded with modules 218 and end modules 220 to span the width of the flex circuit. The first module and the last module inserted into each groove 210A and 210B are end modules 220. The balance are modules 218.

This arrangement of modules makes a continuous groove 228 behind flex circuit 126. Elastomer member 226 is inserted into the groove 228.

Support module 232 with tab 132 attached is inserted into one of the grooves 210A. A module 218 is inserted into groove 210B to occupy the same amount of space as support module 232. The process of inserting modules is repeated for each flex circuit 126 used in the connector.

Flex circuits 126 are then partially wrapped around backbones 110A and 110B. Clamps 130 are put in place. End caps 112 and 114 are secured, holding connector 100 together.

In use, connector 100 is secured to backplane 102 (FIG. 1) with groove 210B (FIG. 2A) facing backplane 102. Elastomer 226 in grooves 228 in the modules in groove 210B is biased by the action of springs 222 and its own elasticity to project beyond the lower surface of backbones 110 containing grooves 210B. These parts push flex circuit 126A below the lower surface of end caps 112 and 114. As connector 100 is secured to backplane 102, elastomer 226 and springs 222 become compressed, creating a counter force. The counter force pushes flex circuit 126A into backplane 102 with a pressure preferably of at least 350 pounds per square inch at the contact interface.

Modules inserted in groove 210A similarly hold flex circuit 126A away from the surface of backbone 110A containing groove 210A. When a daughter card 104 is inserted into slot 118, it compresses elastomer member 226 and springs 222 of the modules in groove 210A. This compression generates a force which pushes flex circuit 126A against daughter card 104 with a pressure preferably in the range of 350 to 500 pounds per square inch.

In this way, the required force to hold flex circuits 126 against both the daughter card and the back plane are generated. The force is uniform across the mating surfaces. Any deviations in the thickness or planarity of daughter card 104 are compensated for by operation of springs 222 and compression of elastomer members 226.

Figure 3:
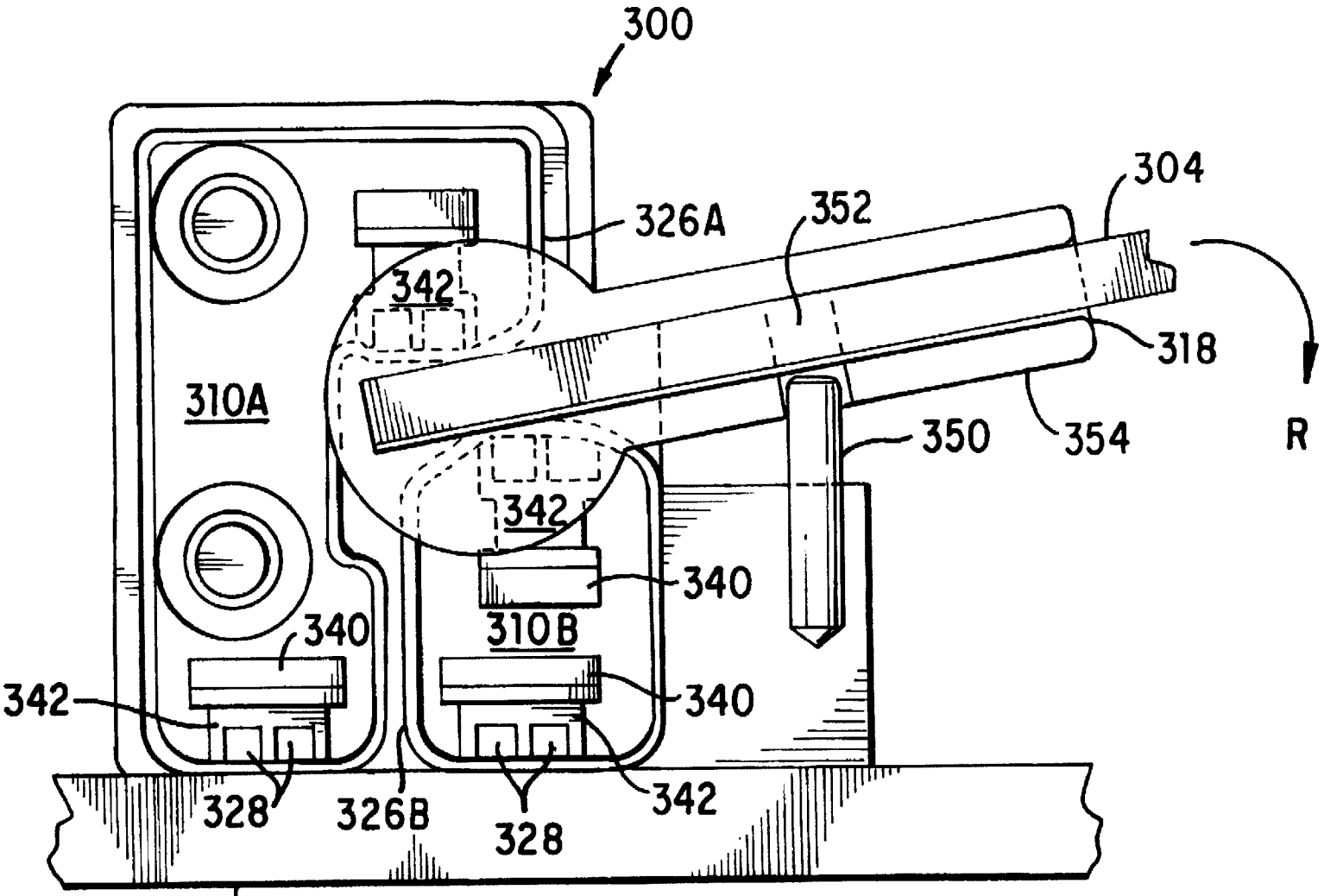
FIG. 3 is a cross sectional view of a connector according to an alternative embodiment of the invention.

Turning now to FIG. 3, an alternative embodiment of the invention is illustrated. FIG. 3 shows a connector 300 in cross section.

Connector 300 utilizes flex circuits 326A and 326B to make connection between mother board 302 and a daughter board 304. Connector 300 is what is sometimes referred to as a mezzanine connector. Such connectors are generally used to connect two boards together in contrast to a backplane which generally is used to connect multiple printed circuit boards together.

As described above in connection with FIG. 1, mother board 302 contains printed circuit traces (not shown) which terminate in contact pads (not shown). These contact pads make contact with contact pads on flex circuits 326A and 326B. Flex circuits 326A and 326B carry the signal on traces to contact pads. These contact pads on flex circuits 326A and 326B contact the similar contact pads on daughter card 304, thereby completing the required connections.

The contact force between flex circuits 326A and 326B and mother board 302 or daughter board 304 is generated through modules 342 inserted in grooves in backbone pieces 310A and 310B. Modules 342 are biased through the use of springs 340 in the same fashion that modules 218 and 220 are biased with springs 222.

Each of the modules 342 contains grooves 328 formed therein. In contrast to FIG. 2A in which a single groove 228 was present, two parallel grooves 328 are present in modules 342. In FIG. 2A, one groove 228 was used because contact pads 124 and 128 are aligned in a single row. In FIG. 3, it is contemplated that the contact pads are aligned in two rows. One groove 328 is aligned with each row of contact pads. An elastomer member (not shown) is inserted into each of the grooves 328.

Backbones 310A and 310B are shaped so that the modules 342 aligned with daughter card 304 are parallel, but are not in the same plane perpendicular to mother board 302. This allows daughter card 304 to be inserted into connector 300 at an angle with respect to mother board 302 without contacting flex circuits 326A or 326B.

In contrast to connector 100 in which grooves 118 were fixed, connector 300 includes end caps with pivot pieces 354. Pivot pieces 354 contain grooves 318. To insert daughter card 304, pivot piece 354 is rotated upwards so that daughter card 304 is easily inserted. Then pivot piece 354 is rotated downwards in the direction R to bring it parallel to mother board 302.

Pivot pieces 354 are mounted to end caps of connector 300 on a shaft or other means to allow it to pivot. Preferably, pivot pieces 354 are inserted in a cavity having a rounded wall so that pivot piece 354 can rotate within the cavity. Pivot piece 354 is mounted about a pivot point selected so that when pivot piece 354 is rotated to be parallel to mother board 302, daughter card 304 will compress springs 340 and the elastomer members in modules 342 adjacent the board.

Pin 350 passes through hole 352 in daughter board 304 to ensure that it is properly aligned and that daughter card 304 is locked in place. In this way, contact pads on daughter board 304 align with contact pads on flex circuits 326A and 326B. If necessary, mother board 302 can include latches (not shown) which lock daughter card 304 in a position parallel to mother board 302.

Having described one embodiment, numerous alternative embodiments or variations might be made. For example, FIG. 1 shows a connector with two bays. However, the connector is assembled from modular elements. A greater or lesser number of elements might be used. In this way, a connector could be made with one bay or multiple bays. The length of each connector can also be dictated by the number of modules used.

Also, it was described that elastomer members 226 are held in a support assembled from several modular pieces. The modular pieces allow conformance of the connector surface along the entire length of the printed circuit boards 102 and 104 even if there are bumps or other uneven features at some places on the printed circuit boards. Alternatively, the support could be formed from a single piece of flexible material.

Support module 232 were described as being manufactured separate from tab 132. The entire piece made up of tab 132 and support module 232 could be molded or machined from a unitary piece. Alternatively, the entire piece could be manufactured using an extrusion process. Tab 132 could then be rounded or shaped if necessary in a machining operation.

FIG. 2A shows that modules are held in grooves 210A and 210B through the use of lips 212 engaging step 224. Any means of retaining the modules in the groove can be used. Springs 222 might lock into recesses in grooves 210A or 210B. Alternatively, a flexible rod might be inserted through holes in the modules and through side walls 112 and 114. In some circumstances, flex circuits 126 alone could be used to hold the modules in the grooves.

Other embodiments can be made by using materials different than those described above. Examples of preferred materials were given. For example, modules 218, end modules 220 and backbones 110 were listed as being made of anodized aluminum. A range of other materials might be used. Other metals providing suitable stiffness could be used. Ceramic or plastic materials might also be used.

Elastomer members 226 and 326 are described as being made of an elastomer. Any compliant material might be used instead. Fluid filled bladders might be used, though their use would be undesirable to some.

Springs 222 were described as being made of bent pieces of spring steel. Coil springs might be used instead. Each module could be backed by one coil spring perpendicular to the surface of the module containing groove 228. It is not necessary that each module have a separate spring associated with it. A coil spring could be run along the floor of grooves 210A and 210B.

It is also not necessary that a traditional spring be used to perform the function of spring 222. Any compliant material could be used to form the spring. Further pieces of elastomer might be used. Alternatively, the floor of grooves 210A and 210B might be lined with a springy material such as a high density foam rubber.

Therefore, the invention should be limited only by the spirit and scope of the appended claims.

What is claimed is:

1. An electrical connector comprising:

a) a flex circuit having a first set of contact pads at a first end, a second set of contact pads at a second end, and a plurality of conductive traces connecting the contact pads in the first set to the contact pads in the second set, wherein the contact pads in the first set and the contact pads in the second set are arranged along a line;

b) a first support member having a first dimension parallel to the line of contact pads in the first set;

c) a first compressible member between the first support member and the first set of contact pads on the flex circuit, the first compressible member extending along the first dimension of the first support member;

d) a first structural member;

e) a spring between the first structural member and the first support member;

f) a second support member having a first dimension parallel to the line of contact pads in the second set;

g) a second compressible member between the second support member and the second set of contact pads on the flex circuit, the second compressible member extending along the first dimension of the second support member; and h) a second spring between the second support member and the first structural member, wherein the first structural member has two grooves formed therein and the first support member extends into the first groove and the second support member extends onto the second groove.

2. An assembly of printed circuit boards comprising:

a) a first printed circuit board;

b) a plurality of contact pads formed on the first printed circuit board;

c) a second printed circuit board;

d) a plurality of contact pads formed on the second printed circuit board;

e) a flexible substrate;

f) a plurality of conductive traces formed on the flexible substrate, each of the conductive traces making contact with a contact pad on the first printed circuit board and a contact pad on the second printed circuit board;

g) a support member connected to the first printed circuit board;

h) a first compliant member, positioned between the support member and the flexible substrate and aligned with the contact pads on the first printed circuit board;

i) a second compliant member, positioned between the support member and the flexible substrate and aligned with the contact pads on the second printed circuit board;

j) first means for generating a force on the first compliant member normal to the first printed circuit board; and k) second means for generating a force on the second compliant member normal to the second printed circuit board, wherein the first and second means for generating a force comprises a member having a groove formed in one surface, wherein the compliant member is disposed in the groove, and a spring compressed between the member having a groove and the support member.

3. The printed circuit board assembly of claim 2 wherein the support member has a groove formed therein and the member having a grooved formed therein is inserted in the groove.

* * * * *